US005768707A

United States Patent [19]

Lederer

[11] Patent Number: 5,768,707

[45] Date of Patent: Jun. 23, 1998

[54] EXAMINATION GOWN

[75] Inventor: Bonnie L. Lederer, Clarinda, Iowa

[73] Assignee: Bonnie Lederer, Clarinda, Iowa

[21] Appl. No.: 820,101

[22] Filed: Mar. 19, 1997

[51] Int. Cl.[6] ..... A41D 1/00

[52] U.S. Cl. ..... 2/114; 2/69; 2/105; 2/912

[58] Field of Search ..... 2/69, 69.5, 75, 2/80, 83, 104, 105, 106, 114, 113, 115, 46, 48, 174, 52, 912, 913, 914, DIG. 2

[56] References Cited

U.S. PATENT DOCUMENTS

| | | | |
|---|---|---|---|
| 1,462,515 | 7/1923 | McElroy | 2/114 |
| 2,668,294 | 2/1954 | Gilpin | 2/114 |
| 3,470,568 | 10/1969 | Belkin | 2/114 |
| 4,570,268 | 2/1986 | Freeman | 2/114 |
| 4,590,624 | 5/1986 | Wieser | 2/114 |
| 4,964,173 | 10/1990 | Gordon et al. | 2/114 |
| 5,062,159 | 11/1991 | Jakub | 2/114 |
| 5,088,117 | 2/1992 | Fulmer | 2/114 |
| 5,361,414 | 11/1994 | Smith | 2/114 |
| 5,440,763 | 8/1995 | Shah et al. | 2/114 |
| 5,444,872 | 8/1995 | Johnson | 2/114 |

OTHER PUBLICATIONS

Gershman, Maurice, "Slef–Adhering Nylon Tapes." The J.A.M.A., vol. 68, No. 7, p. 930, Oct. 1958.

*Primary Examiner*—Jeanette E. Chapman
*Attorney, Agent, or Firm*—Banner & Witcoff, Ltd.

[57] ABSTRACT

An examination gown is formed of fabric and includes six panels. Two upper body panels are joined with four lower skirt panels. The panels are seamed so that two lower side access slits are provided and front and back access slits are provided through the upper body panels.

3 Claims, 3 Drawing Sheets

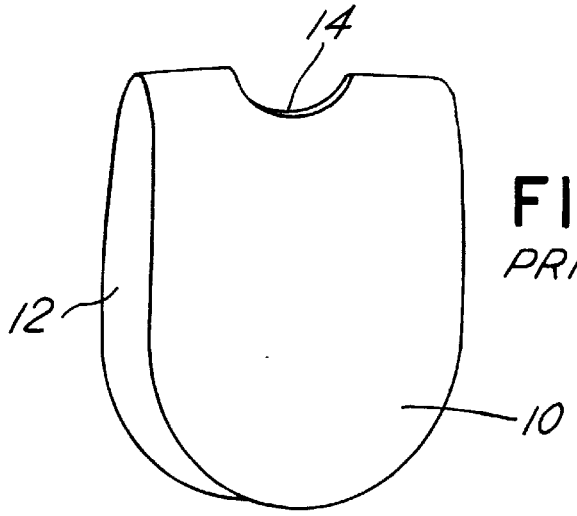
FIG. 1
PRIOR ART
FIG. 2
PRIOR ART
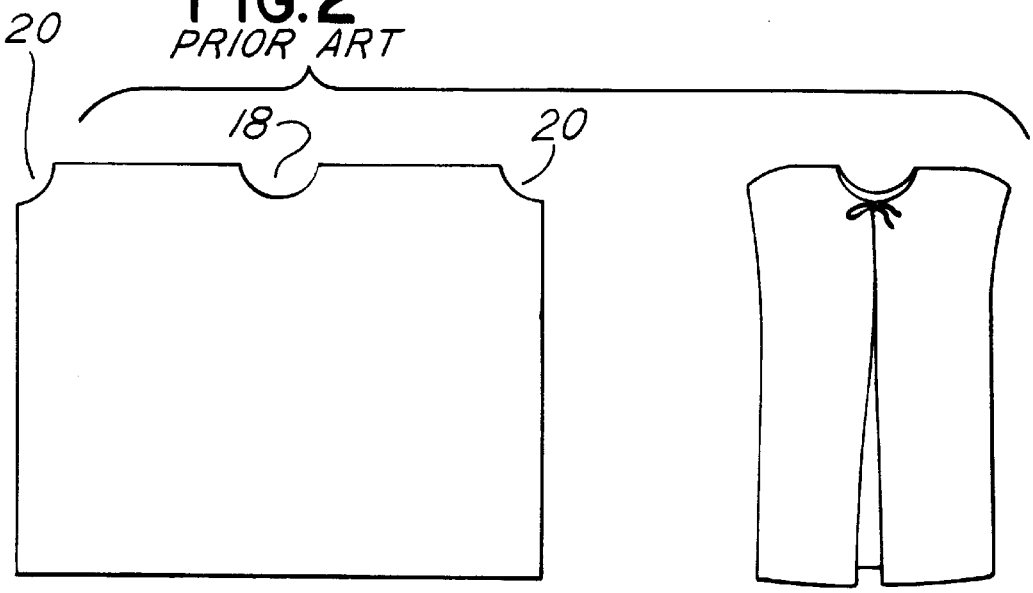
FIG. 3
PRIOR ART
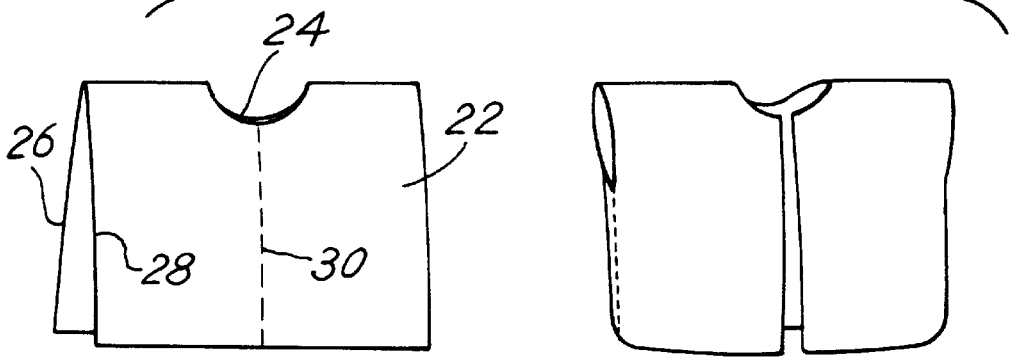

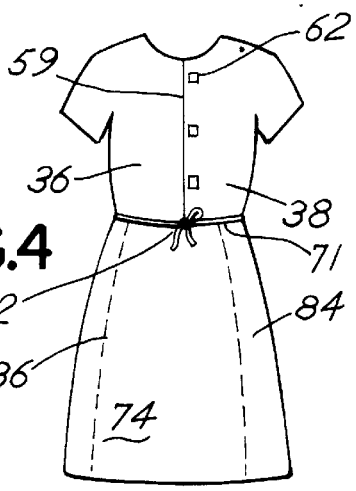
FIG.4
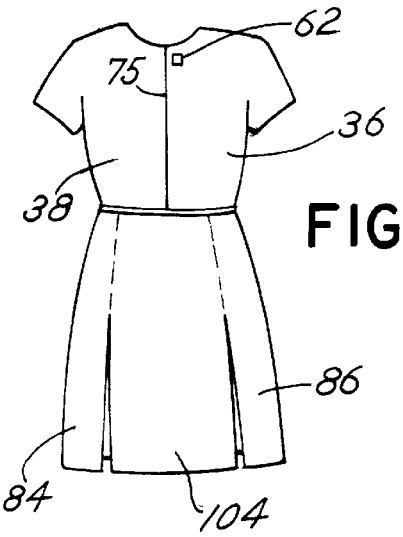
FIG.5
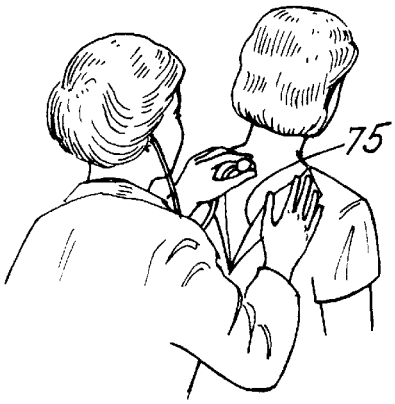
FIG.6
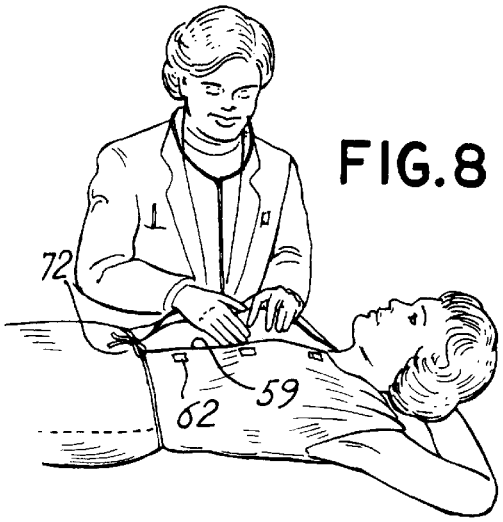
FIG.8
FIG.7
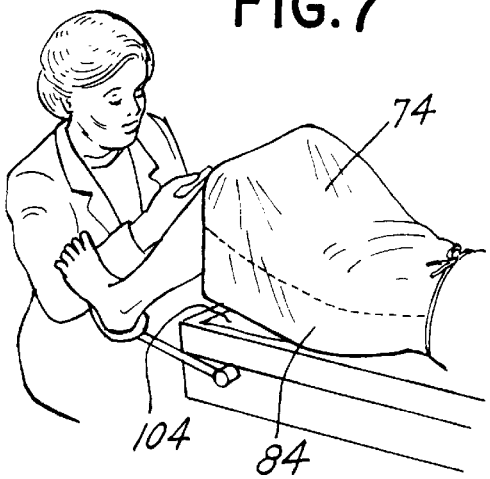

EXAMINATION GOWN

CROSS REFERENCE TO RELATED APPLICATION

This is a utility application based upon a provisional application Ser. No. 60/013,774 filed Mar. 20, 1996 for which priority is claimed.

BACKGROUND OF THE INVENTION

This invention relates to a medical examination gown, particularly useful for female patients. Since the introduction of the Papanicolaou test (Pap smear) in 1943 and it's widespread use for the screening of cervical cancer, there has been a remarkable decrease in the number of deaths from this disease. Presently the American College of Obstetrics and Gynecology recommends that all female patients have a Pap smear and bimanual pelvic exam on a yearly basis starting at age 18 years or at the onset of sexual activity. Despite the efficacy of this test, it is expected that of 15,000 new cases to be diagnosed, 4,000 women will die of cervical cancer. Many of these deaths were women who had chosen not to undergo this annual examination procedure.

The female annual examination also includes a bimanual breast exam. The alarming rise of breast cancer has also prompted much attention. The statistics predict that one in nine women will have breast cancer in their lifetime. The annual exam gives the provider adequate time and attention to instruct and encourage their female patients to do monthly self breast examinations as well as recommend mammograms for those who are at risk. This screening pays a large role in preventative health care.

Many health care providers, realize that this may be the only contact with a patient all year and make an effort to include a complete history, review of systems and a physical examination that encompasses all body systems and provide preventative health counseling.

Their reasons for not having a yearly examination include: not enough time, money, etc., but one of the chief reasons being that the process is somewhat mechanical, uncomfortable, cold and sterile and not to mention humiliating. The "Lithotomy position" in which the patient lies supine on an examining table and has her feet placed in stirrups and the examiner's head in direct view of her pelvic region is an unnervingly vulnerable situation. To make this experience even more degrading, many of the patient gowns/garments are physically uncomfortable using materials such as paper and plastic as well as fabric, but also the garments of the past do not cover the body appropriately. Often times, patients feel ill at ease because their breasts are protruding out from under, or out from the sides of the vest type top garment or they are sitting with their perineum in direct contact with the table paper or worse yet, a bare exam table. The possibility of early detection and treatment of a possibly fatal disease designates the female annual examination and screening as crucial for a woman's well-being. Completeness of caring for women dictates that the psychosocial or non-physical aspects of her life must also be attended to; if the patient feels uncomfortable physically or emotionally, she will not want to verbalize enough to allow for this conversation to take place.

The present invention seeks to overcome the described problems and provide an improved examination gown.

SUMMARY OF THE INVENTION

The present invention comprises an examination gown that will make it less uncomfortable for a female patient by covering more of a woman's body surface and yet allow the health care provider access to assess all of her organ systems. The gown is a comfortable examination gown that covers the same surface area as a regular woman's dress, but allows all organ systems to be assessed as well as the breast exam and the Pap smear with minimal exposure of the patient.

The gown includes a top bodice panel forward from two pieces of fabric with front and back access slits. The top bodice panel connects to a pair of separate lower skirt panels along a waist line. A drawstring is provided through a drawstring passage formed along the waist line. The lower panels are configured so that a front panel and side panels are seamed together and a back panel defines access slits therebetween with the side panels.

Thus it is an object of the invention to provide an improved gynecological examination gown.

It is a further object of the invention to provide an examination gown which may be easily manufactured from approximately six separate pre-cut panels wherein two panels form an upper bodice section and four panels form a lower skirt section of the gown.

Another object of the invention is to provide an examination gown which may be reused, which preserves patient privacy, which may be manufactured from fabric so as to be fluid absorbent more easily than prior art gowns and which is cost effective.

These and other objects, advantages and features of the invention will be set forth in a detailed description which follows.

BRIEF DESCRIPTION OF THE DRAWING

In the detailed description which follows, reference will be made to the drawing comprised of the following figures:

FIG. 1 is an isometric view of a prior art paper or fabric poncho;

FIG. 2 is a typical prior art patient gown, which may be used with a paper drape;

FIG. 3 is a typical prior art paper vest with a paper drape;

FIG. 4 is a front view of the gown of the invention;

FIG. 5 is a back view of the gown of the invention;

FIG. 6 is a perspective vie of the gown of the invention as used during auscultation;

FIG. 7 is a perspective view of the gown of the invention as used during the lithotomy position;

FIG. 8 is a perspective view of the gown of the invention as used during breast examination.

DESCRIPTION OF THE PREFERRED EMBODIMENT

Figure 9:
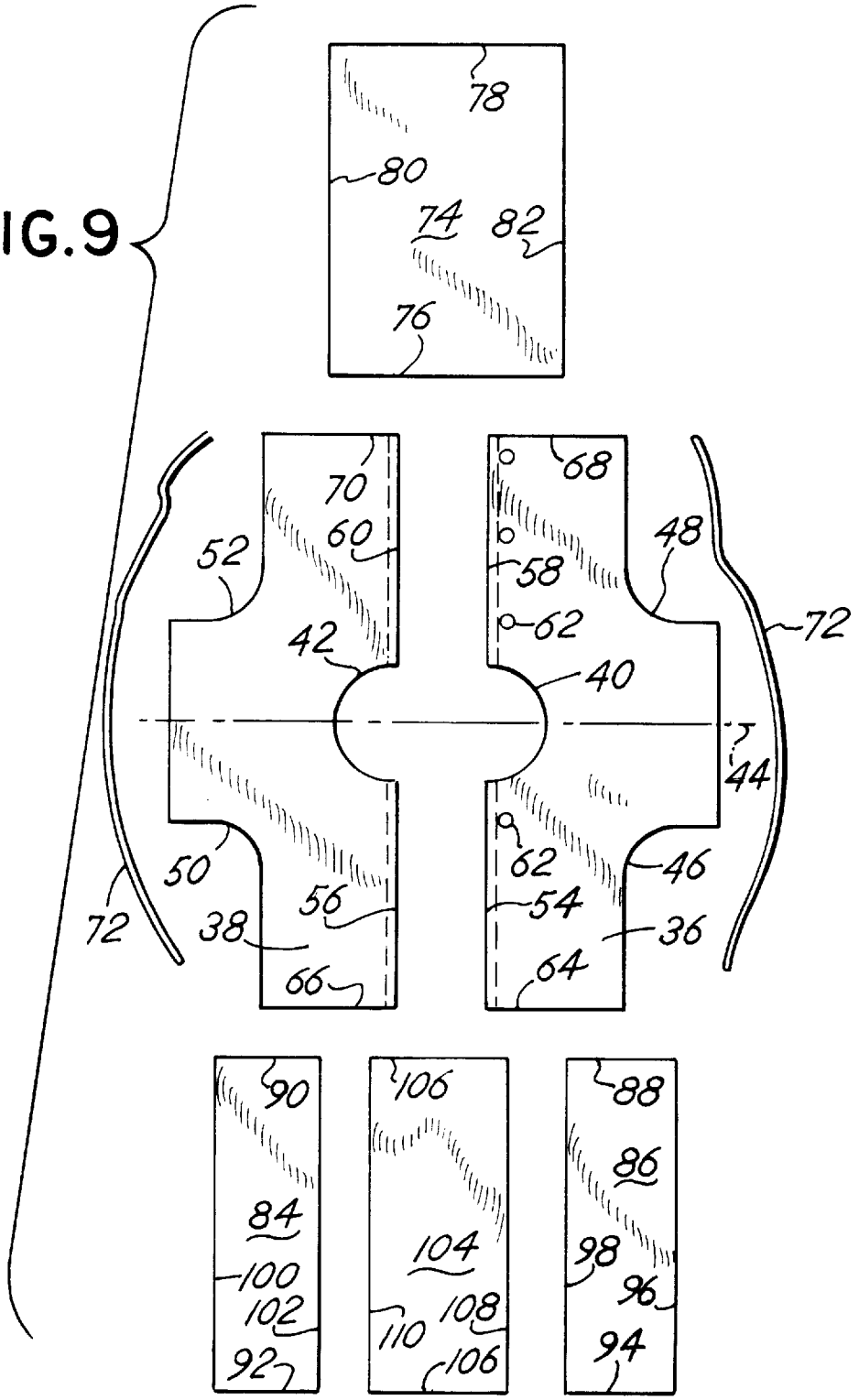
FIG. 9 is a plan view or layout of the separate panels forming the examination gown of the preferred embodiment of the invention.

The gown is manufactured using approximately 3 yards of a polyester/cotton blend floral print fabric that is cut using a pattern and sewn. The neckline is jewel cut, simple and rounded without a collar. The gown has simple rounded, full short sleeves. It opens down the front to the waist and is fastened using 3-one-inch Velcro tab closure sets. This allows for the breast exam in which only the breast being examined is exposed.

The back is slit 12 inches from the neckline in the middle to allow for respiratory assessment or lung auscultation as well as skin inspection. The top of the back necking is also fastened by using 1-one-inch square Velcro tab closure set. The rest of the posterior side of this garment remains intact. The waistline in the front of the garment is designed in a drawstring structure in order to allow for a stable fit while the patient is upright as well as to allow for the examination of the abdomen when the drawstring is loosened.

The skirt section or outseam is 25.5 inches long and is intact in front and 2-six-inch slits front he bottom of the garment upward each 14 inches from each side seam allows for the patient to be in the Lithotomy position and not have the skirt gather inward when the patient relaxes her legs. The skirt construction also allows for the patient's perineum to be in contact with the fabric when sitting upright and not have her buttocks exposed from the sides. The length of the skirt also makes the use of a drape unnecessary.

The construction described above gives the garment to be a unique "one size fits all" for women that are approximately size 2–18 in Misses dress sizing. An extra-large gown is provided for women that are size 20–36 in Women's dress sizing. The construction of the larger size gown will have different dimensions, but be the same in all design features.

Referring to FIG. 1, there is depicted a typical prior art examination gown which is a one-piece gown with a front panel 10, a back panel 12 and a neck or head opening 14 in the single sheet forming the front panel 10 and back panel 12.

FIG. 2 depicts a typical prior art gown formed from a single panel wherein the gown is essentially a single panel and the edges of the panel are made to face one another with a tie string to join the edges adjacent to the neck scallop. Thus a single panel 16 is pre-cut so as to be folded in the manner illustrated schematically by the gown in FIG. 2. Neck scallops 18 and 20 are cut into the panel 16 and thereby a single panel garment is formed.

FIG. 3 illustrates a similar prior art construction wherein a single panel 22 with a neck scallop 24 has its sides 26 and 28 adjoined to form a vest like garment. The garment is slit along a line 30 to permit front access.

FIGS. 4 through 9 illustrate the improved examination gown of the present invention. The gown is preferably manufactured from fabric or material so that it may be washed and reused. Moreover, fabric is often considered by patients to be more comfortable than paper which is typically used in many prior art gowns. Additionally, the construction of the gown of the present invention illustrated by FIGS. 4 through 9 enhances the privacy or modesty of a patient and thus is considered to provide a more dignified environment for the examination involved.

FIG. 9 illustrates the basic component parts of the gown, and FIGS. 4 and 5 illustrate the assembled gown. FIGS. 6 through 8 illustrate the method of the utility associated with the gown.

Referring to these figures, the gown is comprised of a right-hand bodice panel 36 and a left-hand bodice panel 38. The bodice panels 36 and 38 are substantially mirror images of one another. Each panel 36, 38 includes a neck scallop 40 and 42. The neck scallop 40 and 42 is fashioned in a side of the bodice panels 36 and 38 and is generally symmetrical about a median shoulder line 44. Arm scallops 46 and 48 are defined in bodice panel 36. Arm scallops 50 and 52 are defined in bodice panel 38. The facing sides of bodice panels 36 and 38, namely sides 54 and 56 respectively as well as sides 58 and 60 respectively, face one another in the final assembled gown but are not seamed together to define slits 59, 75. Optional fasteners such as Velcro fasteners 62 may be used to temporarily join the facing sides 54, 56 and 58, 60. Each right and left hand bodice panel 38 and 36 includes a waistline side 64, 66, 68 and 70. These sides 64, 66, 68, 70 are joined to the other panels (as described below) to define a drawstring or waist string passage opening or for receipt of a tie string or waist string 72.

A front skirt panel 74 includes a waist string or waist side 76, a bottom side 78 and opposite connecting sides 80 and 82. Skirt panel 74, as are all the skirt panels used to manufacture the gown, is generally rectangular, though trapezoidal or other polygonal shapes may be utilized. In general, the skirt panels are substantially rectangular in configuration. The waist string side 70 of front skirt panel 74 is joined to the waist string sides 68 and 70 of bodice panels 36 and 38. Openings for the tie string 72 are provided so that the string 72 may be drawn tautly around the patient's waist. The distance from the median shoulder line 44 to the sides 64, 66, 68 and 70 is typically the standard distance from a patient's shoulder to waist. Clearly there is a great degree of flexibility in this regard inasmuch as the gown is made from fabric which permits flexibility in sizing.

Generally rectangular side skirt panels 84 and 86 include a waist string side 88 and 90, a bottom side 92 and 94 respectively and connecting sides 96, 98, 100 and 102 respectively. The right-hand side panel 86 includes one connecting side 96 joined to the front panel 74 along its side 82. They are joined by a seam. Similarly panel 84 includes a connecting side 100 seamed to the side 80 of panel 74. The waist string sides 88 and 90 of the panels 84 and 86 include a waist string opening for cooperation with the waist string 72.

Finally, the back skirt panel 104 includes a waist string side 106 joined to the waist string sides 64 and 66 of bodice panels 36 and 38. Again, this is for the purpose of connecting the panels as well as permitting the waist or drawstring 72 to be extended through a passage or opening for retaining the gown on the patient. The back skirt panels 104 further include the bottom side 106 and left and right lateral sides or connecting sides 108 and 110. The sides 108 and 110, which are connecting sides, are not seamed. Rather they remain open and define slits with the adjacent skirt panels 84 and 86. The length of the connecting sides of the various panels is substantially equal so that the skirt formed by the panels 74, 84, 86 and 104 has a generally uniform length. Clearly the length may be varied depending upon the desired patient usage and typical patient size.

Referring to FIG. 4, it will be seen that the bodice panel 36 and bodice panel 38 form the upper bodice of the gown. Front skirt panel 74 forms the front skirt. FIG. 5 illustrates the side skirt panels 86 and 84 which are joined to the back skirt panel 104. Again, the upper bodice is formed of panels 36 and 38 which are joined together along the waistline. It is possible on the back side of the gown to seam a portion of the sides 54 and 56 together when defining a back slit 75.

FIGS. 6, 7 and 8 illustrate the examination procedures that may be utilized. In FIG. 6, the back slit 75 defined by the sides 56 and 54 is opened. In FIG. 7 the front panel 74 is moved. In FIG. 8 the front slit 59, defined by sides 58 and 60, is opened.

Various alternations to the gown construction of the invention are possible while remaining within the spirit and scope of the invention. For example, the configuration of the panels may be altered. The various dimensions of the separate panels may be altered. It is possible, though not preferred, that the side panels may be formed integrally with the front panel 74. Various other combinations and permutations of the gown construction are possible. Of course, fabric such as a cotton fabric or synthetic and cotton mixture are preferred though other materials may be utilized. Thus while there are set forth various preferred embodiments of the invention, it is understood that the invention is to be limited only by the following claims and their equivalents.

What is claimed is:

1. An examination gown for a female patient comprising in combination:

an upper bodice comprised of two panels and a lower skirt comprised of four panels, said upper bodice having a top with a neck scallop and arm scallops, and a horizontal waist line;

said gown including the six joined panels:

(a) a right-hand bodice panel with a median shoulder line, a neck scallop on one side of the shoulder line generally centered on the shoulder line, right bodice panel extensions in opposite directions from the shoulder line defining examination slit sides of the right bodice panel, said panel extensions extending from the shoulder line a generally equal extent to a front and back waist line, arm scallops on the side of the right bodice panel opposite the neck scallop, said arm scallops extending from the waist line partially toward the median shoulder line defining at least seamed sides;

(b) a left-hand bodice panel which is substantially a mirror image of the right-hand bodice panel;

(c) a generally rectangular back skirt panel having an upper waist line side, a left access side, a right access side, and a bottom side, said waist line side joined to the back waist line of the two bodice panels, said back skirt panel not seamed at the access sides;

(d) a generally rectangular front skirt panel having an upper waist line side, a left seamed side, a right seamed side and a bottom side, said waist line side positioned at the front waist line of the two bodice panels;

(e) left and right generally rectangular side skirt panels, each of side skirt panels having a waist line side, a bottom side and sides connecting the waist and bottom sides, said left seamed side panel seamed on one side to the left seamed side of the front skirt panel, the right seamed side panel seamed on one side to the right seamed side of the front skirt panel, said waist line sides including a connected waist string;

said waist string connected to said left and right rectangular sided skirt panels at the waist line sides; and bodice examination slits defined medially along the front and back of the bodice by the said left and right examination slit sides of the said left and right bodice panels above the waist line and access slits are defined between the said left and right rectangular side skirt panels and said rectangular back skirt panel below the waist line.

2. The gown of claim 1 including fasteners for the front and back bodice slits above the waist.

3. The gown of claim 2 wherein the fasteners are hook and loop fasteners.

* * * * *